US005110061A

United States Patent [19]

Berry

[11] Patent Number: 5,110,061

[45] Date of Patent: May 5, 1992

[54] PNEUMATIC REEL FIBER PAY OUT SYSTEM

[76] Inventor: Roger P. Berry, 1000 Wood Cir., Madison, Ala. 35758

[21] Appl. No.: 623,315

[22] Filed: Dec. 3, 1990

[51] Int. Cl.[5] ..... B65H 54/00

[52] U.S. Cl. ..... 242/47; 242/1; 242/47.01

[58] Field of Search ..... 242/47, 47.01, 47.08, 242/47.09, 82, 83, 1; 57/66; 226/97

[56] References Cited

U.S. PATENT DOCUMENTS 4,744,394 5/1988 Lincke ..... 242/47.01 X
4,784,344 11/1988 Lenk et al. ..... 242/47.01
4,817,880 4/1989 Lenk et al. ..... 242/47.01
4,880,177 11/1989 Lenk et al. ..... 242/47.01
4,890,800 1/1990 Lenk et al. ..... 242/47.01
5,018,678 5/1991 Peterson ..... 242/47

*Primary Examiner*—Stanley N. Gilreath

[57] ABSTRACT

Apparatus for pneumatically pulling on optical filament from test bobbin and winding the optical filament onto the surface of a non-rotating spool. The filament is guided about the surface of the spool by one or more streams of fluid at supersonic flow and is wound into a groove in the cylindrical surface of the spool. The filament is wound onto the supply bobbin so that withdrawal of the filament from the supply bobbin imparts a twist to the filament as it is withdrawn and the filament is wound onto the spool in a direction which imparts a twist to said filament in the opposite direction to that the twist imparted by pulling the filament from the supply bobbin is offset by the twist imparted to the filament while winding the filament on the spool.

10 Claims, 2 Drawing Sheets

PNEUMATIC REEL FIBER PAY OUT SYSTEM

DEDICATORY CLAUSE

The invention described herein may be manufactured, used, and licensed by or for the Government for governmental purposes without the payment to me of any royalties thereon.

BACKGROUND OF THE INVENTION

This invention relates to a pneumatic reel fiber pay out system which pulls a fiber or filament from a stationary bobbin and winds it onto a non-rotating spool by using high speed gas or fluid flow to generate a drag force on the fiber or filament.

More particularly the invention relates to apparatus from pneumatically pulling and winding an optical filament onto a non-rotating spool from a stationary supply bobbin. The invention includes guide means to guide the optical filament into a fluid stream which is created by a stationary means and driven at a supersonic speeds around the non-rotating spool. This stream acts as a fluid guide to wind the filament or fiber onto the surface of the non-rotating spool.

Missile systems such as the fiber optic guided missile (FOG-M) use fiber optic data links for communication between the missile and the gunners station during flight. Typically these systems contain a tapered cylindrical bobbin of filament carried by the missile which is payed out from the rear of the missile during its flight. In order to economically test a variety of bobbin fiber concepts or configurations, and to better understand the physics of the fiber pay out, a method for ground testing such bobbins is required.

Typical test methods have consisted of mounting a supply bobbin on an instrumented test stand and using a device to pull the fiber or filament from the bobbin. Such systems currently available include a pneumatic shoe and a pinch wheel. The pneumatic shoe pay out system uses a high speed rotating disk to pull the fiber or filament from the test bobbin. When the disk reaches the desired speed, gas is blown through orfices in the pneumatic shoe which forces the filament onto the rotating disk. Friction between the filament and the disk causes the filament to be pulled from the stationary supply bobbin and thrown downstream of the pneumatic shoe.

The pinch wheel pay out system, on the other hand, uses two driven disks to nip the filament and to pull it from the test bobbin. Each of these disks is coated with a high friction material on the surface which contacts the filament. When the two disks reach the desired surface speed they are closed together to nip or pinch the filament. This pulls the filament from the stationary bobbin and throws it downstream of the pinch wheel nipping device.

These two pay out devices or systems do not provide for an orderly collection of the filament after its pay out nor do they allow for the transmission of signals through the filament during the pay out itself. Transmission of signals through the filament is very desirable in such test devices because it allows the determination of the attenuation caused by the filament stresses induced during the pay out test. In addition, if the filament is collected in a orderly manner, attentuation, due to the high stresses induced by the collection device will be reduced. Each of the prior art systems also requires the use of high speed rotating parts which reduces the reliability of the devices and increases their maintenance cost.

SUMMARY OF THE INVENTION

The present invention relates to a pneumatic reel pay out system which uses the drag force induced by high speed gas or fluid flow to pull filament from a stationary bobbin and to wind it onto a non-rotating spool. This device comprises an inner spool and a stationary outer housing disposed about the spool. The filament is positioned between the spool and housing and its end is threaded through a hole in a V-shape groove on the spool and it is connected to a signal transmitting device. A plurality of tangential supersonic air nozzles are placed about the circumference of the housing and each imparts an aerodynamic drag force to the fiber which pulls the fiber from the stationary supply bobbin and winds it into a V-shaped groove on a non-rotating spool so that the tested filament is collected in an orderly fashion. This system offers the advantages of collecting the filament in an orderly manner and still permitting data to be transmitted through the filament during the testing. The pneumatic reel pay out system also contains no moving parts which improves its reliability and lowers its maintenance cost.

It is the object of the present invention to provide a reel pay out system for pneumatically pulling an optical filament from a stationary supply bobbin and winding the pulled filament onto a non-rotating spool in an orderly manner.

It is a further object of the invention to provide a reel pay out system wherein the filament being payed out is drawn over the end of the stationary supply bobbin by pneumatic forces which winds the payed out filament onto a stationary spool, so as to impart a twist thereto opposite to the twist imparted by drawing the filament over the end of the supply bobbin.

BRIEF DESCRIPTION OF THE DRAWING

An embodiment of the invention will now be described in conjunction with the attached drawings, in which.

DETAILED DESCRIPTION OF THE INVENTION

Figure 1:
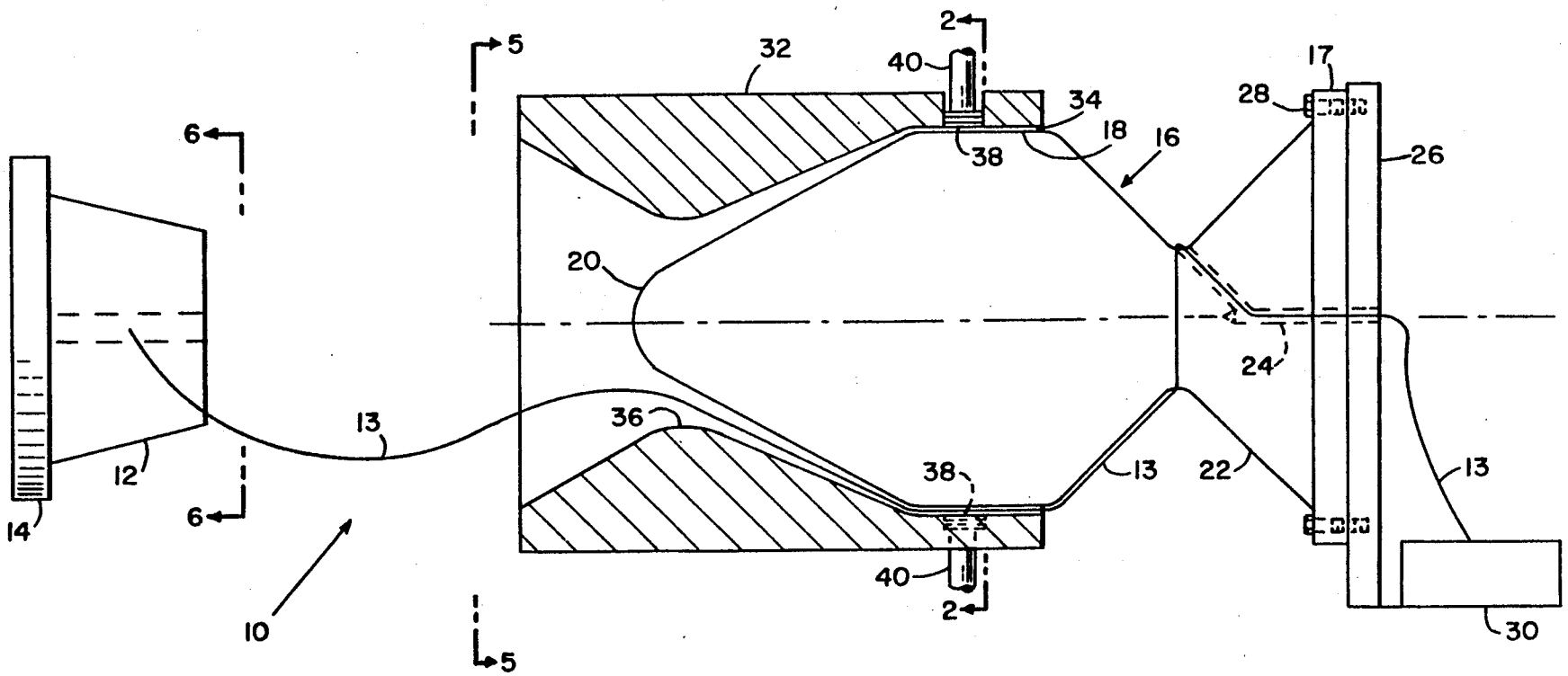
FIG. 1 is a side view of the pay out system of the invention, with parts thereof of in section for clarity.

Referring now to FIGS. 1, 2, 3 and 4 of the drawings wherein a static filament winding and testing apparatus 10 is illustrated. Apparatus 10 comprises a stationary supply package 12 or bobbin of fiber optic filament or fiber 13. Stationary supply package 12 is supported on a support member 14 to permit filament 13 to be drawn off over the end of bobbin or supply package 12.

Filament 13 is guided onto the surface of the stationary spool 16 which is mounted on a stationary non-rotating spool base 17. The stationary spool 16 has a cylindrical portion 18 and a frustoconical nose portion 20. Spool 16 also has a filament storage groove 22 extending around the circumference of cylindrical portion 18 for storing the filament 13. Spool base 17 is bolted to a spool support 26 by a plurality of bolts or screws 28 to hold it stationary and non-rotating. At the base of groove 22, and extending through spool base 17 and spool support 26 is a filament guide channel 24. Filament 13 extends through channel 24 and to a signal transmitting device 30 whereby signals maybe transmitted to and from said signal transmission device 30, and through said filament 13 on supply package 12 by transmitter means (not shown).

Disposed about spool 16 is stationary winding housing 32 which has a clearance 34 between the outer surface of the cylindrical portion 18 of spool 16 and stationary housing 32. The clearance 34 between spool 16 and the winding housing 32 widens along the surface of spool nose portion 20 to permit ease of entry of filament 13 into clearance 34.

Figure 2:
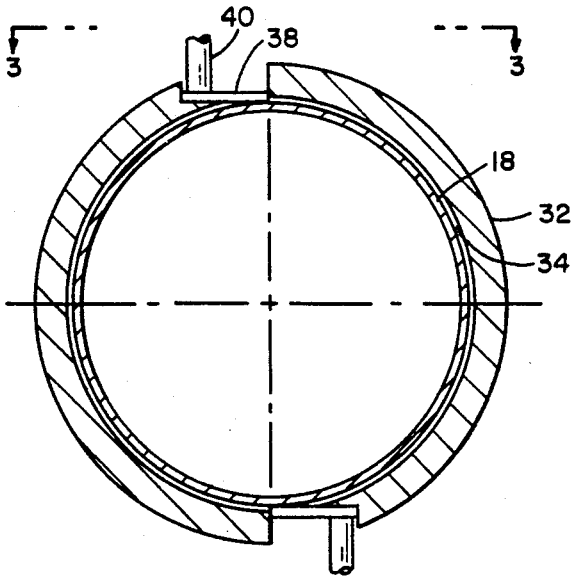
FIG. 2 is a sectional view taken along line 2—2 in FIG. 1.
Figure 4:
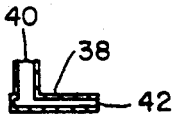
FIG. 4 is a cross sectional side view of the pneumatic nozzle of FIG. 3, taken along line 4—4 of FIG. 3.
Figure 3:
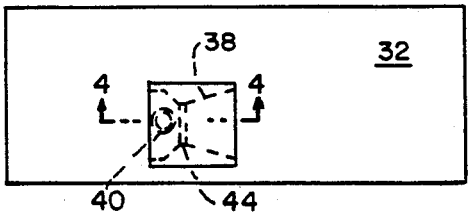
FIG. 3 is a plan view of the pneumatic nozzle of the invention taken along line 3-3 in FIG. 2.
Figure 6:
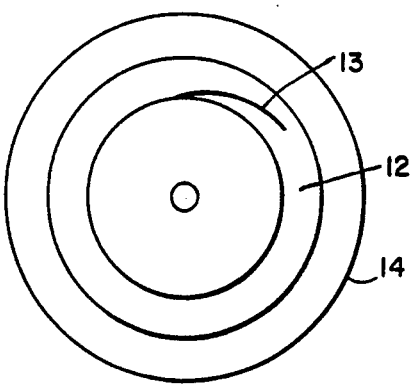
FIG. 6 is an end view of the stationary supply bobbin, taken along line 6—6 of FIG. 1, showing the direction of the filament withdrawal from the bobbin.

A plurality of tangential supersonic air nozzles 38 are disposed about the outer circumference of cylindrical portion 18 of spool 16 and the inner circumference of housing 32, as seen best in FIGS. 1 and 2. Nozzles 38 open in gap or clearance 34 at a tangent to the surface of cylindrical portion 18. Each of the nozzles 38 is supplied with air by air supply line 40. Each of the nozzles 38 has outer outlet 42 and a restricted section 44 to accelerate air supplied by air supply line 40. In any event, air admitted from nozzles 38 swirls about the surface of cylindrical portion 18, between the outer surface of spool portion 18 and the inner surface of housing 32. The movement of the air at supersonic speed through gap or channel 34 carries filament 13 in a spiral about the spool 16, depositing the filament in groove 22 and drawing off filament 13 from spool 12.

Figure 5:
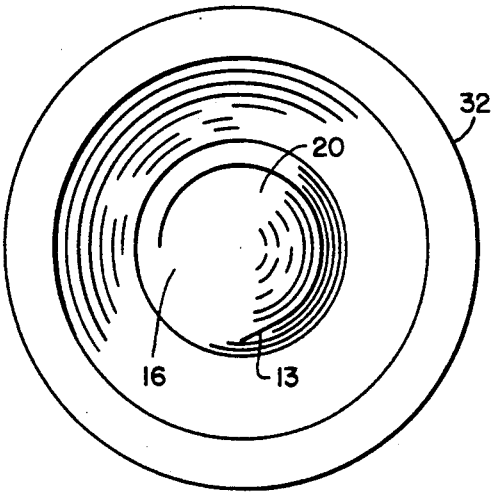
FIG. 5 is an end view of the take up device of the invention, taken along line 5—5 of FIG. 1.
Figure 5A:
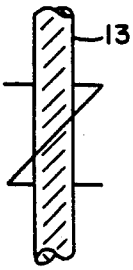
FIG. 5*a* is a schematic illustration of the filament being wound onto the stationary spool showing the direction of the twist imparted thereto.

Referring now to FIGS. 5, 5*a*, 6 and 6*a*, it will be seen that filament 13 is wound onto spool 16 in a clockwise direction thereby imparting one turn of Z twist, as seen in FIG. 5*a* for every coil of filament 13 wound in groove 22.

Figure 6A:
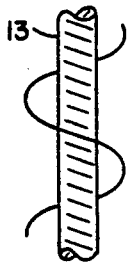
FIG. 6*a* is a schematic illustration of the filament as it drawn off of the stationary bobbin, showing the direction of the twist imparted thereto.

At the same time, filament 13 is drawn off of package 12 in a counter clockwise direction which imparts one turn of S-twist for each coil of filament drawn off package 12 as seen in FIG. 6*a*. The S-twist imparted to filament 13 will be cancelled or counteracted by the Z-twist imparted by winding filament 13 about spool 16, thereby avoiding the build up of twist within the filament 13 and avoiding snarls in the recovered filament.

While only two nozzles have been illustrated in the drawings described hereinabove, it will be understood by those skilled in the art that a plurality nozzles, evenly spaced about the circumference of cylindrical portion of 18 of spool 16 and supported by housing 32 can be used to increase the efficiency of winding process and to accelerate the winding and pulling of the filament from supply bobbin 12, without departing scope of the claims appended hereto.

I claim:

1. Apparatus for testing wound optical filament bobbins under conditions simulating operational conditions, comprising:

(a) a stationary support for supporting a filament bobbin against rotation in a fixed position;

(b) a non-rotating cylindrical spool for receiving said filament from a filament bobbin supported on said stationary support;

(c) stationary means disposed about the circumference of said spool for creating a supersonic stream of fluid between said stationary means and the surface of said non-rotating spool and for guiding said optical filament between said stationary means and said surface of said spool, and through an opening in said spool;

(d) a stationary signal transmitting means connected to an end of said filament for transmitting signals through said filament during the testing of said optical filament; and (e) control means for controlling said supersonic stream of fluid between said spool surface and said stationary means to pull said filament from said bobbin and for winding said filament about said spool.

2. Apparatus as set forth in claim 1, wherein said spool is provided with a filament storage groove on a cylindrical portion of said spool.

3. Apparatus as set forth in claim 1, wherein said stationary means comprises a tangential nozzle for creating said supersonic stream of fluid.

4. Apparatus as set forth in claim 3, wherein said stationary means comprises a plurality of stationary tangential nozzles for creating said supersonic stream of fluid.

5. Apparatus as set forth in claim 1, wherein said spool has a generally conical nose portion-that cooperates with an internal generally conical surface in said stationary means to guide said filament onto said spool.

6. Apparatus for pneumatically pulling an optical filament from a supply bobbin and winding said filament onto a non-rotating spool, comprising:

(a) a stationary supply bobbin for supplying an optical filament;

(b) a non-rotating spool for receiving said optical filament;

(c) stationary means for creating a supersonic stream of fluid around the surface of said non-rotating spool and for guiding said optical filament into said fluid stream for entraining and winding said filament onto an outer surface of said non-rotating spool; and (d) control means for controlling the flow of said supersonic stream of fluid about the surface of said spool for pulling said optical filament from said supply bobbin and for winding said filament onto the surface of said spool.

7. Apparatus as set forth in claim 6, wherein said spool is provided with a filament storage groove on a cylindrical portion of said spool.

8. Apparatus as set forth in claim 6, wherein said stationary means comprises a tangential nozzle for creating said supersonic stream of fluid.

9. Apparatus as set forth in claim 8, wherein said stationary means comprises a plurality of stationary tangential nozzles for creating said supersonic stream of fluid.

10. Apparatus as set forth in claim 6, wherein said spool has a generally conical nose portion that cooperates with an internal generally conical surface in said stationary means to guide said filament onto a cylindrical surface of said spool.

* * * * *